US012440031B2

(12) United States Patent
Sherman et al.

(10) Patent No.: US 12,440,031 B2
(45) Date of Patent: Oct. 14, 2025

(54) BACK SUPPORT FOR A CHAIR

(71) Applicant: Haworth, Inc., Holland, MI (US)

(72) Inventors: Mark Sherman, Zeeland, MI (US); William Schroeder, Jenison, MI (US); Weston Boerckel, Hudsonville, MI (US); William Reck, Muskegon, MI (US); Adam VerBeek, Holland, MI (US)

(73) Assignee: Haworth, Inc., Holland, MI (US)

( * ) Notice: Subject to any disclaimer, the term of this patent is extended or adjusted under 35 U.S.C. 154(b) by 228 days.

(21) Appl. No.: 17/901,105

(22) Filed: Sep. 1, 2022

(65) Prior Publication Data

US 2024/0074587 A1 Mar. 7, 2024

(51) Int. Cl.

| | |
|---|---|
| ***A47C 7/46*** | (2006.01) |
| ***A47C 7/18*** | (2006.01) |
| ***A47C 7/40*** | (2006.01) |

(52) U.S. Cl.

CPC ..... *A47C 7/462* (2013.01); *A47C 7/18* (2013.01); *A47C 7/402* (2013.01)

(58) Field of Classification Search

CPC ..... A47C 7/462; A47C 7/18; A47C 7/402
See application file for complete search history.

(56) References Cited

U.S. PATENT DOCUMENTS

| | | | | |
|---|---|---|---|---|
| 4,403,356 | A | 9/1983 | Urai | |
| 5,102,196 | A | 4/1992 | Kaneda et al. | |
| 5,105,491 | A | 4/1992 | Yoshiyuki et al. | |
| 5,294,181 | A | 3/1994 | Rose et al. | |
| 6,217,121 | B1 | 4/2001 | Mollet | |
| 6,220,661 | B1 | 4/2001 | Peterson | |
| 6,336,681 | B1 | 1/2002 | Crosbie | |
| 6,409,268 | B1 | 6/2002 | Cvek | |
| 6,481,801 | B1 | 11/2002 | Schmale | |
| 6,755,467 | B1 * | 6/2004 | Chu | A47C 7/46 297/284.4 |
| 6,908,159 | B2 | 6/2005 | Prince et al. | |
| 7,032,971 | B2 * | 4/2006 | Williams | A47C 7/405 297/DIG. 2 |
| 7,216,388 | B2 | 5/2007 | Bieganek et al. | |
| 7,445,292 | B2 | 11/2008 | Moule | |
| 7,794,022 | B2 | 9/2010 | Caruso et al. | |
| 8,449,037 | B2 | 5/2013 | Behar et al. | |
| 8,973,990 | B2 | 3/2015 | Krupiczewicz et al. | |
| 9,096,147 | B2 * | 8/2015 | Kulkarni | B60N 2/68 |
| 9,125,493 | B2 | 9/2015 | Siekman et al. | |

(Continued)

FOREIGN PATENT DOCUMENTS

JP 2005021263 A 1/2005

*Primary Examiner* — Philip F Gabler
(74) *Attorney, Agent, or Firm* — Warner Norcross + Judd LLP

(57) ABSTRACT

An office-type chair includes a back support having a support frame, front and rear shells, a cushion and a cover. The perimeter edge of the cover wraps around the side of the cushion and the front shell and is inserted between the front and rear shells to form a finished edge for the cover. The front shell may include a central flex section, and a lumbar pad may be positioned between the front shell and the rear shell and adjacent to the central flex section. One or more lumbar enhancement ribs on the front shell may augment the pressure distribution of the lumbar pad as it is vertically adjusted.

19 Claims, 12 Drawing Sheets

(56) References Cited

U.S. PATENT DOCUMENTS

| | | | | |
|---|---|---|---|---|
| 9,167,910 | B2 | 10/2015 | Krupiczewicz et al. | |
| 9,173,491 | B2 | 11/2015 | Vander Veen et al. | |
| 9,480,340 | B1 | 11/2016 | Harlow | |
| 9,706,853 | B2 | 7/2017 | Krupiczewicz et al. | |
| 9,986,848 | B2 | 6/2018 | Krupiczewicz et al. | |
| 10,182,657 | B2 * | 1/2019 | Beyer | B68G 5/00 |
| 10,264,889 | B2 | 4/2019 | Battey et al. | |
| 10,413,083 | B2 | 9/2019 | Krupiczewicz et al. | |
| 10,492,612 | B2 | 12/2019 | San Miguel et al. | |
| D883,690 | S * | 5/2020 | Dassen | |
| 10,842,281 | B2 | 11/2020 | Battey et al. | |
| 11,229,294 | B2 | 1/2022 | Battey et al. | |
| 2005/0017565 | A1 | 1/2005 | Sprouse | |
| 2011/0121624 | A1 * | 5/2011 | Brncick | B60N 2/68 297/284.2 |
| 2014/0117732 | A1 * | 5/2014 | Bachar | A47C 7/402 297/285 |
| 2016/0338514 | A1 | 11/2016 | Chan | |
| 2019/0133328 | A1 * | 5/2019 | Beyer | A47C 7/462 |
| 2020/0345142 | A1 * | 11/2020 | Battey | A47C 1/0308 |
| 2021/0282557 | A1 | 9/2021 | Gleason et al. | |

* cited by examiner

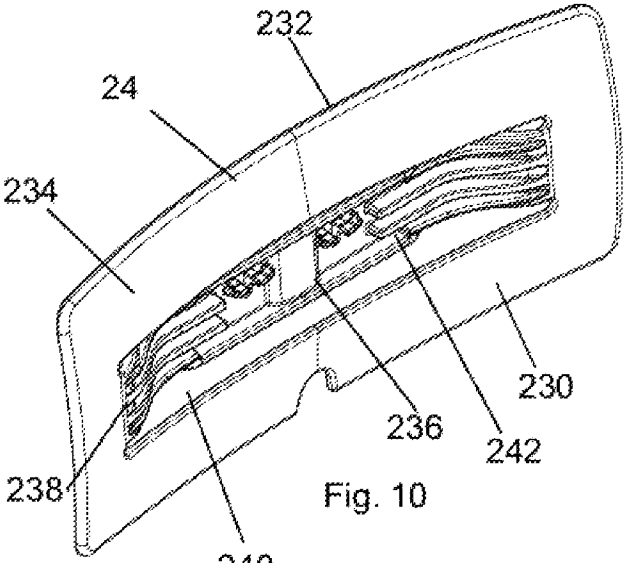
Fig. 10
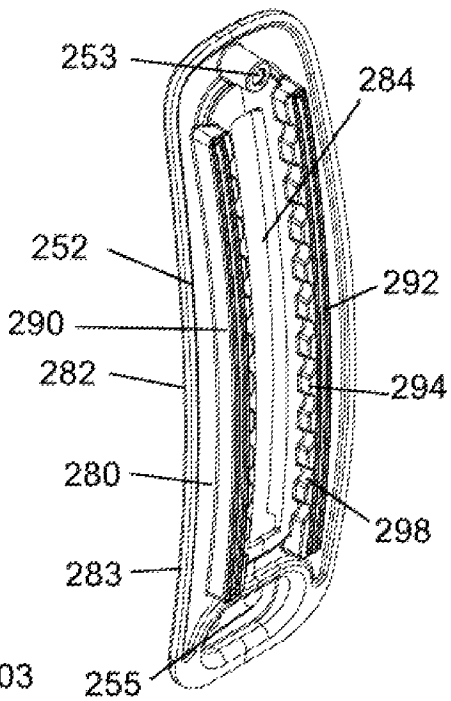
Fig. 11
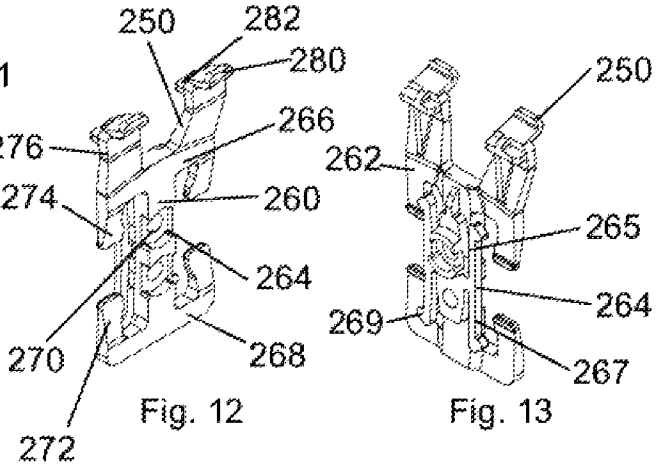
Fig. 12
Fig. 13
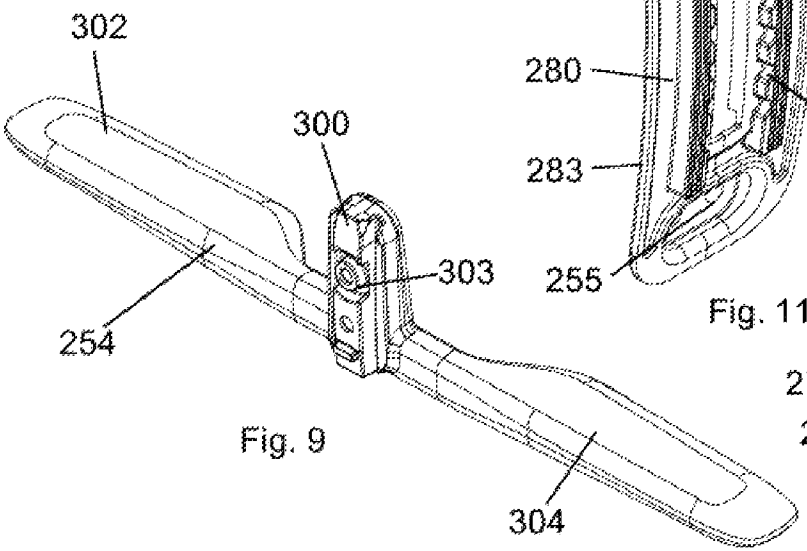
Fig. 9

BACK SUPPORT FOR A CHAIR

BACKGROUND OF THE INVENTION

The present invention relates to an office chair and more particularly, to a backrest portion of an office chair.

The market for office seating continues to demand more than just a place to sit. Today's users want comfort, function, and adjustability, all in an aesthetically pleasing configuration. One common type of office chair includes a seat back support, or backrest, that includes a foam cushion covered with an upholstery. The cushion provides a degree of comfort for the back of a user, and can be upholstered in a wide variety of fabrics and materials depending on the desired function and aesthetics. In some cases, however, it can be difficult to manufacture these upholstered back supports, particularly when adding features to provide enhanced support characteristics for the back support. For example, it can be difficult to incorporate a user adjustable lumbar support into an upholstered back where the user can conveniently adjust the position of the lumbar support. Past attempts have focused on vertical adjustability of the entire upholstered back. It can be difficult to provide lumbar adjustment in a context where the adjustment can be meaningfully experienced by the user, and the seat back and lumbar mechanism are covered by the upholstery in an aesthetically pleasing manner.

SUMMARY OF THE INVENTION

The present invention provides an upholstered back support for an office type chair with easy to manufacture and aesthetically pleasing comfort and support features. In one embodiment, the back support includes a support frame, front and rear shells, a cushion and a cover. The rear shell is mounted to the support frame, and includes a rear surface facing the support frame and a front surface opposite the rear surface. The front shell has a rear surface facing the rear shell and a front surface opposite the rear surface. The cushion has a rear surface facing the front shell and a front surface opposite the rear surface. The cover is positioned over the front surface of the cushion to cover the cushion.

In one embodiment, the cover has a perimeter edge that wraps around the side of the cushion and the front shell and is inserted between the front and rear shells to form a finished edge for the cover. In another embodiment a rear cover may extend over the rear surface of the rear shell, and may also include a perimeter that wraps around the rear shell and is inserted between the front and rear shells. The cover may be a variety of materials, including a fabric.

In another embodiment, the back support includes a lumbar pad positioned between the front shell and the rear shell. The lumbar pad may be vertically adjustable within a lumbar region of the back support. In one embodiment, the rear shell defines an opening in the lumbar region, and the back support includes a handle having a portion extending through the rear shell opening and attached to the lumbar pad, wherein movement of the handle causes corresponding movement of the lumbar pad.

In one embodiment, the front shell includes features configured to engage and interact with the lumbar pad. For example, at least one lumbar enhancement rib may extend from the rear surface of the front shell in a direction toward the rear shell, and the lumbar pad may engage the lumbar enhancement rib in at least one position during the vertical adjustment of the lumbar pad. The lumbar enhancement rib may extend in a generally vertical direction and defines a rib height in a direction extending away from the rear surface of the front shell. In one embodiment, the rib height at the upper end of the lumbar enhancement rib is greater than the rib height at the bottom, and in another embodiment the rib height gradually increases approaching the upper end of the lumbar enhancement rib. The interference between the lumbar pad and the lumbar enhancement rib may act to augment and enhance the user experience of lumbar support on the front shell as the lumbar pad is vertically adjusted.

The front shell may also include a central flex region that is capable of flexing, and may also be capable of moving with respect to the remainder of the front shell. In one embodiment the central flex section is separated from the remainder of the front shell by an outer slot extending around the central flex section to enable flexing or movement of the central flex section with respect to the remainder of the front shell. The central flex section is connected to the remainder of the front shell only by a series of connector webs, with each of the webs traversing the outer slot. The central flex section includes a top edge, left and right lateral edges, and a bottom edge formed by the outer slot, and in one embodiment there are no connector webs along the top edge. In another embodiment, the back support includes at least one left connector web on the left lateral edge of the central flex section and at least one right connector web on the right edge of the central flex section, the left and right connector webs spaced from the top edge of the central flex section. In yet another embodiment, the central flex section includes a series of inner slots that provide the central flex section with a degree of flexibility. The inner slots may include a series of horizontally extending, vertically spaced openings in the central flex section of the front shell.

The cushion may enhance the localized comfort characteristics of the back support. In one embodiment, the cushion includes a central cushion section having a series of convolutions. The central cushion section may be positioned above the lumbar region of the back support to provide enhanced comfort to a thoracic region of the user.

These and other objects, advantages, and features of the invention will be more fully understood and appreciated by reference to the description of the current aspects and the drawings.

Before the aspects of the invention are explained in detail, it is to be understood that the invention is not limited to the details of operation or to the details of construction and the arrangement of the components set forth in the following description or illustrated in the drawings. The invention may be implemented in various other aspects and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various aspects. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 9 is a perspective view of a lumbar adjustment handle.

FIG. 10 is a perspective view of a lumbar pad.

FIG. 11 is a perspective view of a lumbar adjustment track.

FIG. 12 is a front view of a lumbar slide latch according to one embodiment.

FIG. 13 is a rear view thereof.

DETAILED DESCRIPTION OF THE CURRENT EMBODIMENT

I. Overview

Figure 1:
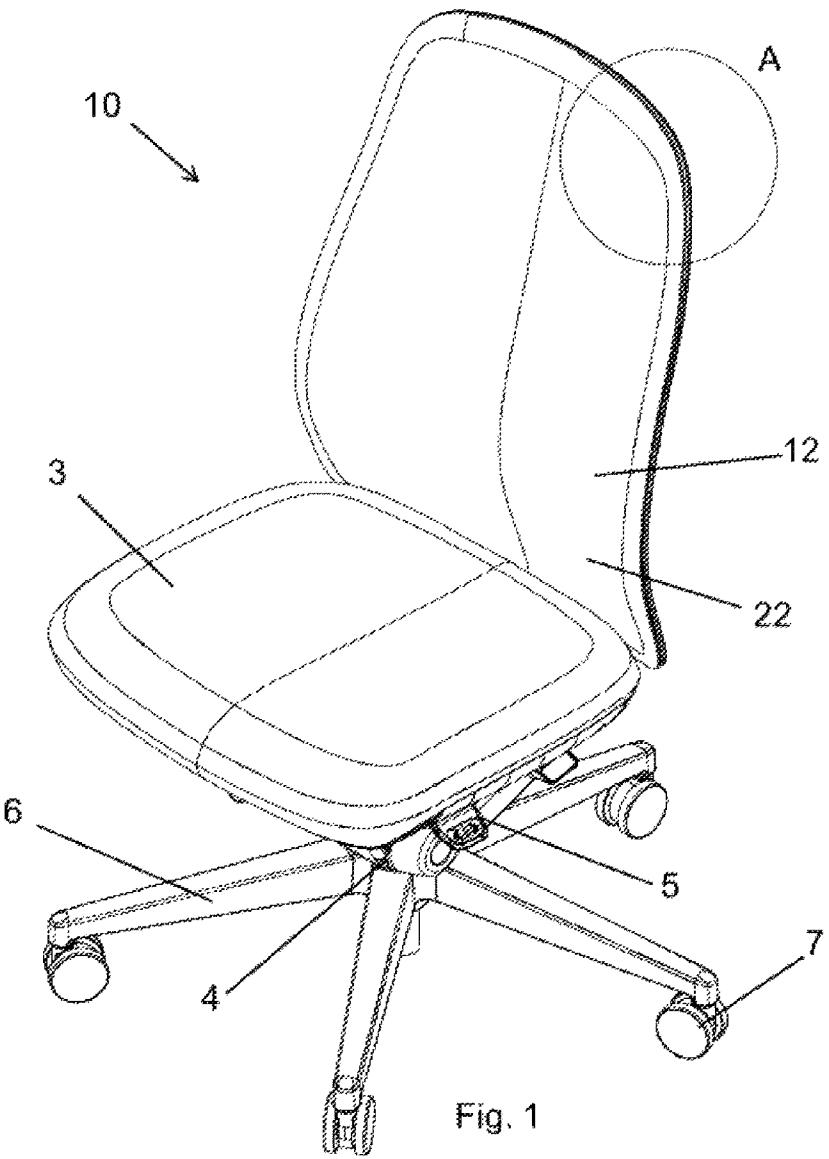
FIG. 1 is a front perspective view of an office type chair with a back support according to one embodiment of the present invention.

An office-type chair 10 is shown in FIG. 1 and generally includes a back support 12 constructed in accordance with an embodiment of the present invention. Although FIG. 1 illustrates the back support 12 as part of a complete chair 10 with a seat support 3 and other support structure, this is only exemplary. The back support 12 may be generally used in connection with any structure intended to provide seated back support. In particular, the embodiments of the office chair 10 disclosed in the present application include the back support 12 for comfortably supporting the back of a user and an efficient method of manufacturing and assembling such a back support.

FIG. 1 shows a view of an exemplary version of the chair 10. The office chair 10 generally includes a seat support 3 supported on a base 5. The seat support 3 defines an upward facing support surface on which the occupant is supported. The base 5 may include a height adjustable pedestal 4 having plurality of outwardly extending legs 6 to which casters 7 are pivotally mounted. Further, the chair 10 may include a tilt control mechanism.

Figure 3:
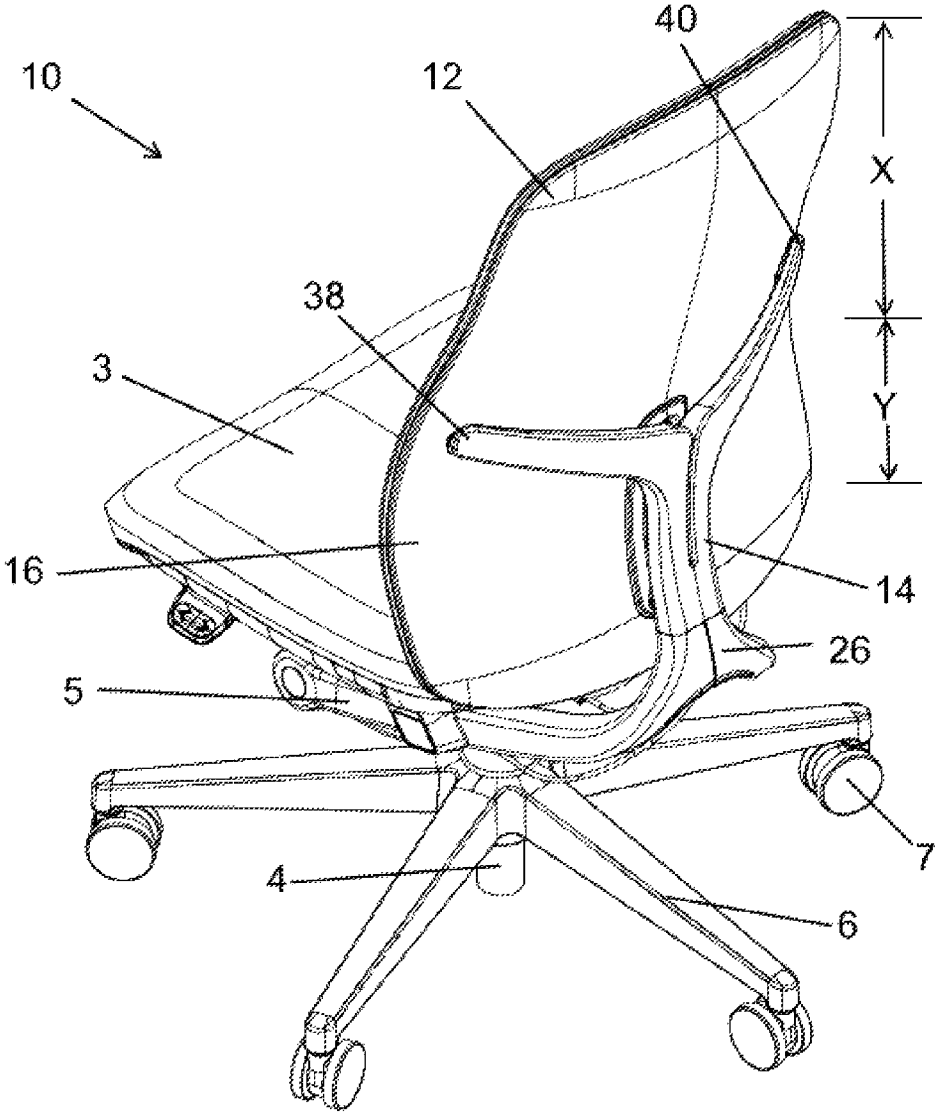
FIG. 3 is a rear perspective view of an office type chair with the back support according to one embodiment.

The back support 12 of the present invention generally defines thoracic X, and lumbar Y regions as illustrated in FIG. 3. The support characteristics provided by the back support 12 may be different in the different regions X, Y. The lumbar region Y may provide enhanced support with adjustability, while the thoracic region X may provide a greater or varied degree of cushioning. In one embodiment, the lumbar region Y has a natural support curve, which aids in comfort and proper posture for a seated occupant.

In the illustrated embodiment, the back support 12 generally includes a support frame 14 connected to and extending from the base 5, a rear shell 16 mounted on the frame 14, a front shell 18 attached to the rear shell 16, a cushion 20 positioned in front of the front shell 18, and a cover 22 covering the cushion 20. A vertically adjustable lumbar pad 24 may be positioned between the front 18 and rear 16 shells, and the front shell 18 may be provided with structure that enhances the user experience of the lumbar pad 24. The cover 22 may be a fabric upholstery with a portion that is inserted between the front 18 and rear 16 shells.

II. Structure

Figure 4:
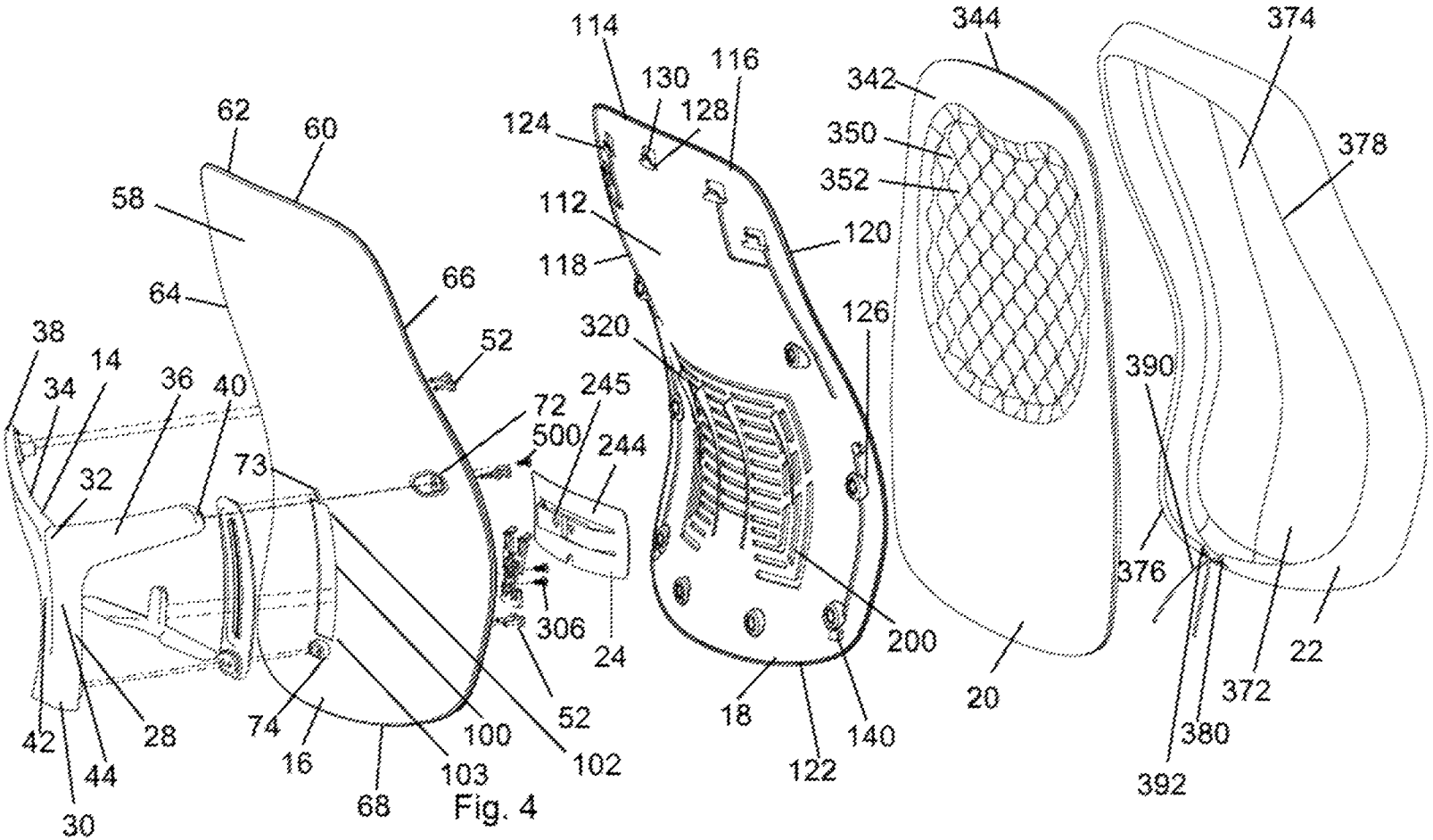
FIG. 4 is a rear exploded view of a back support according to one embodiment.
Figure 5:
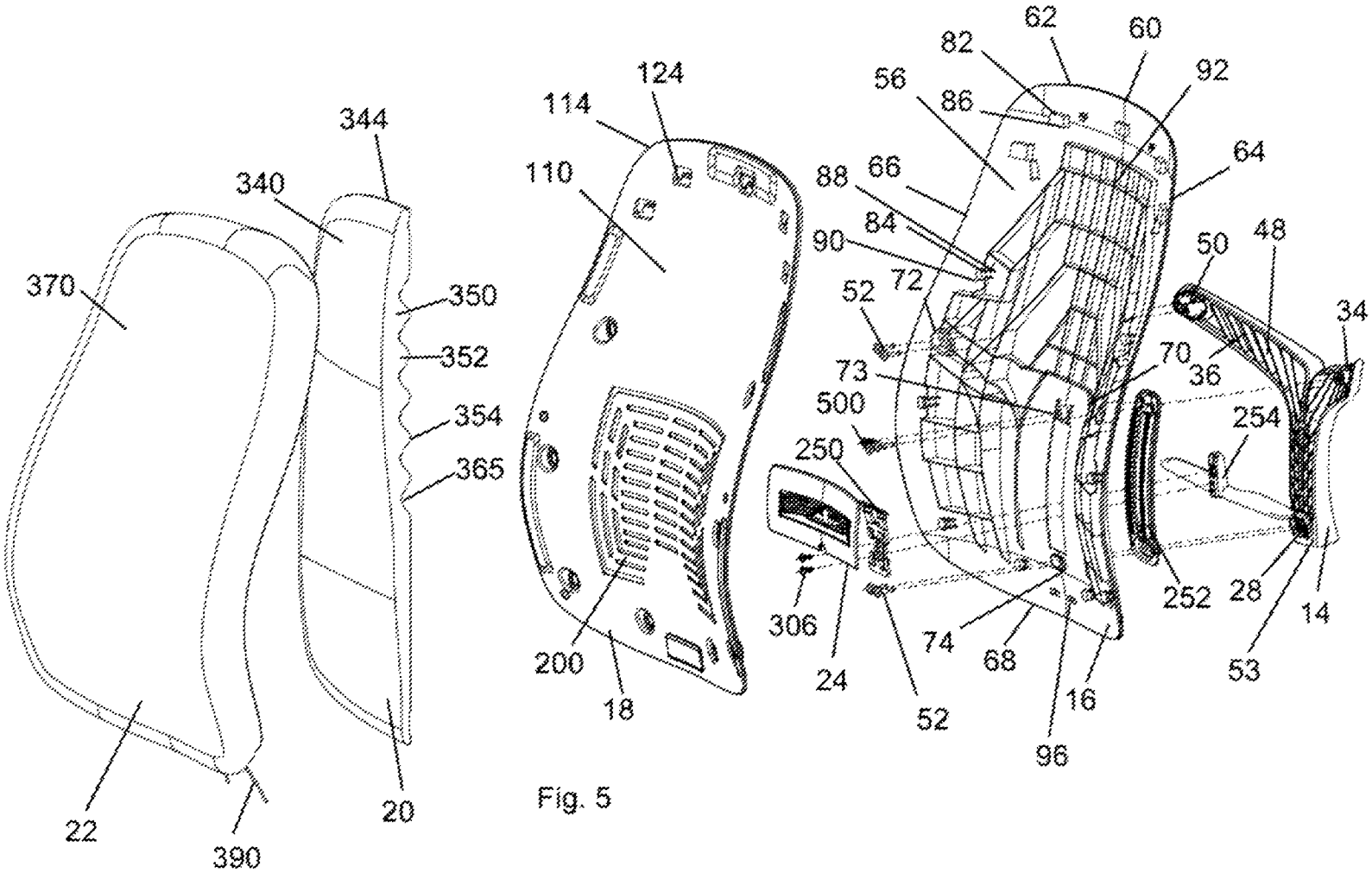
FIG. 5 is a front exploded view thereof.

As shown in FIGS. 3-5, the support frame 14 connects the back support 12 to the frame 5. In one embodiment the frame 5 includes an attachment point for the support frame 14, and the attachment point may be a receptacle 26 on the frame 5. The support frame 14 generally includes a vertical post 28 that interfits with the receptacle 26, for example, by inserting a portion of the vertical post 28 into the receptacle 26. In the illustrated embodiment, the support frame 14 includes the vertical post 28, having a first end 30 attached to the frame 5 and a second, upper end 32. A pair of lateral posts, including a left lateral post 34 and a right lateral post 36 extend from the upper end 32 of the vertical post 28. The left lateral post 34 extends to a left distal end 38, and the right lateral post extends to a right distal end 40. The lateral posts 34, 36 may extend at an angle from the vertical post 28 such that the support frame 14 has a split shape, such as a Y-shape or a T-shape. In one embodiment, the vertical post 28 splits into a left vertical portion 42 and a right vertical portion 44, with the left lateral post 34 extending from the left vertical portion 42 and the right lateral post 36 extending from the right vertical portion 44. The lateral posts 34, 36 may curve forward toward the back support 12, forming a generally concave front surface 48. Referring to FIGS. 4 and 5, the distal ends 38, 40 may each include attachment structure, such as an attachment boss 50 protruding outwardly therefrom to form a receptacle for a securement device such as one or more screws or other fasteners 52. The vertical post 28 may also include an attachment boss 53 protruding outwardly therefrom to form a receptacle for a pair of the fasteners 52.

The support frame 14 may be formed from a variety of materials, such as a cast metal or an injection molded plastic; and the vertical post 28 and lateral posts 34, 36 may be formed integrally from a single piece of molded plastic. In one embodiment, the entire support frame 14 is molded as a unitary piece, with portions of the support frame 14 molded to predetermined dimensions that will provide the overall back support 12 with a desired support profile when the support frame 14 is combined with the back support components as described below.

The rear shell 16 is mounted on the support frame 14 and forms a support and attachment structure for the front shell 18. In one embodiment, the rear shell 16 is a molded plastic shell extending through the lumbar X and thoracic Y regions of the back support 12 and having a front surface 56, a rear surface 58 and a perimeter edge 60 having a top edge 62, lateral edges 64, 66, and a bottom edge 68. The rear surface 58 is generally convex and faces the support frame 14. The front surface 56 is generally concave, and faces away from the support frame 14.

The rear shell 16 may have a variety of integrally molded features for providing support and for attaching to the various back support components. With reference to FIG. 4, the rear shell 16 defines openings for attachment of the rear shell 16 to the support frame 14. In the illustrated embodiment, these attachment openings include a pair of lateral openings 70, 72 and a bottom opening 74 extending through the front 56 and rear 58 surfaces of the rear shell 16. The lateral openings 70, 72 are positioned adjacent to the respective lateral edges 64, 66 of the rear shell 16, at approximately the transition point between the lumbar region Y and the thoracic region X. The bottom opening 74 is positioned adjacent to the bottom edge 68 of the rear shell 16. The lateral openings 70, 72 are positioned to align with the attachment bosses 50 on the distal ends 38, 40 of the left lateral post 34 and the right lateral post 36. The bottom opening 74 is positioned to align with the attachment boss 53 on the vertical post 28 of the support frame 14, and in one embodiment includes a pair of fastener holes 74 (or other securement features) that can be used for attachment to the frame 14 as well as for attachment of a lumbar track 252 as described below. The openings 70, 72, 74 may receive securement devices 52 extending into the bosses 50, 53 to mount the rear shell 16 to the support frame 14 at three locations. The support and comfort advantages of these three attachment locations are described in more detail below, although additional and alternative attachment arrangements may also be used. In one embodiment, the split shape of the frame 14, and the connection locations of the frame 14 to the rear shell 16 may provide a degree of torsional flex within the frame to increase the flexibility and comfort of the back support 12.

Figure 18:
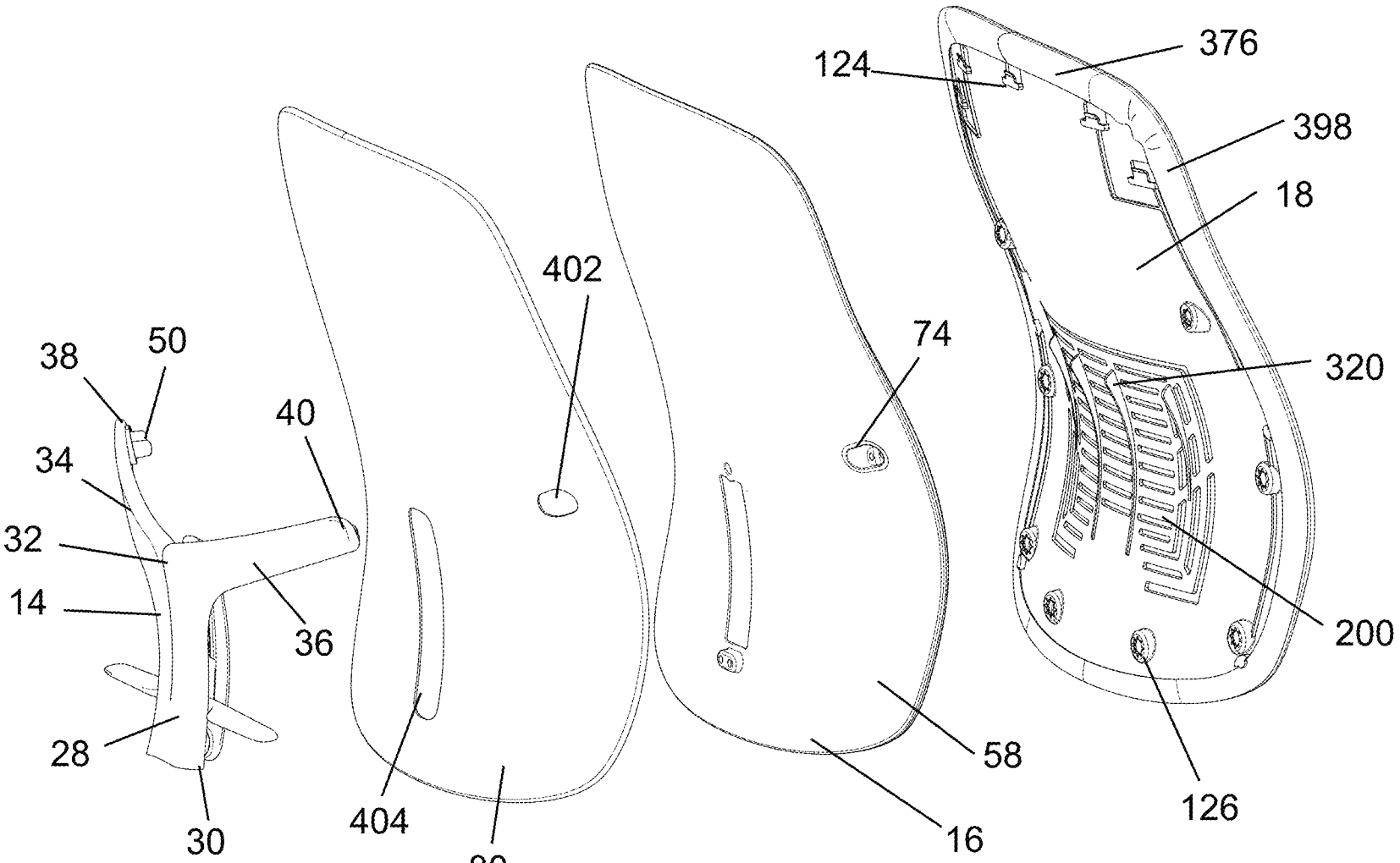
FIG. 18 is a rear perspective partially exploded view of a back support according to one embodiment.
Figure 19:
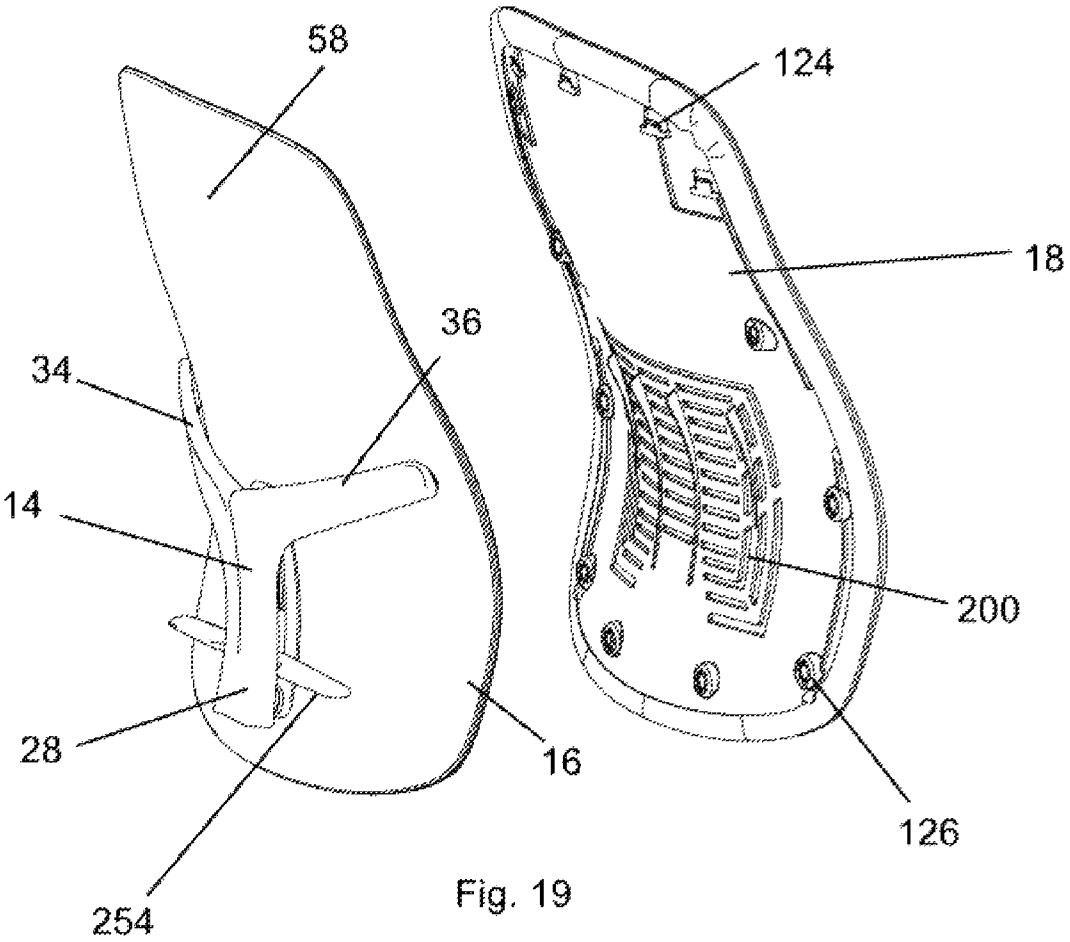
FIG. 19 is another rear perspective partially exploded view thereof.

In one embodiment, the rear shell 16 further includes integrally molded structure for attachment to the front shell 18 and for attachment to a rear cover 80 (shown in FIG. 18). With reference to FIG. 5, the front surface 56 of the rear shell 16 includes a series of hook receptacles 82 and snap posts 84 for tool-less attachment to the front shell. The hook receptacles 82 may be box like structures extending outwardly form the front surface 56, each defining an open bottom edge 86 that forms a receptacle. In one embodiment, the hook receptacles 82 are positioned spaced apart along the top edge 62 of the rear shell 16. The snap posts 84 may have a stem 88 extending outwardly from the front surface 56 of the rear shell 16, and a head 90 at the end of the stem 88. In one embodiment, the snap posts 84 are positioned spaced apart from each other along the bottom edge 68 of the rear shell 16 and lower portions of the side edges 64, 66 of the rear shell 16. The rear shell 16 may also include a series of integrally molded intersecting support ribs 92 extending from the front surface 56 for added structural support. The rear shell may also include one or more drawstring guides 96, which may be integrally molded posts 96 extending from the front surface 56.

In one embodiment the rear shell further defines a lumbar slot 100 positioned in the lumbar region Y and generally centrally located along the lateral extent of the rear shell 16. The lumbar slot 100 may have a vertical extent that spans substantially all of the vertical extent of the lumbar region Y, the lumbar slot 100 including an upper end 102 and a lower end 103. In one embodiment, the upper end 102 is positioned vertically below the lateral attachment openings 70, 72. An upper fastener hole 73 may be included above the lumbar slot 100.

The front shell 18 attaches to the front surface 56 of the rear shell 16. The front shell 18 may be a molded plastic shell, and in the illustrated embodiment includes a front surface 110, a rear surface 112, and a perimeter edge 114. The shape of the front shell 18 and extent of the perimeter edge 114 may correspond to that of the rear shell 16, such that the perimeter edges 60, 114 of the respective shells are coterminous. The perimeter edge 114 of the front shell 18 may include a top edge 116, left and right side edges 118, 120, and a bottom edge 122.

Figure 8:
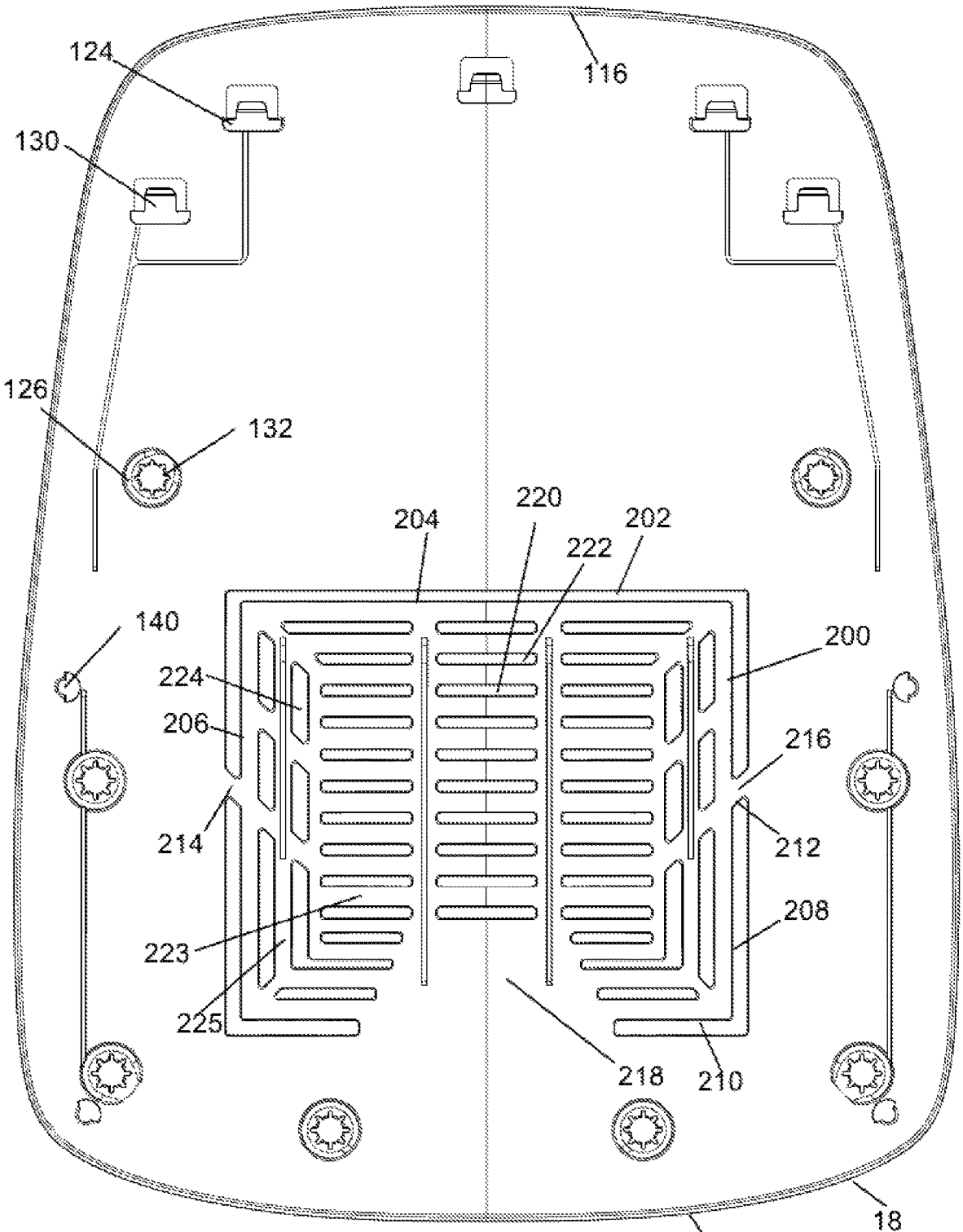
FIG. 8 is a rear view of the front shell according to one embodiment.

Referring to FIGS. 4, 5 and 8, the front shell 18 may include integrally molded structure to enable attachment to the rear shell 16 and the cover 22. The structure for attaching to the rear shell 16 may include a series of hooks 124 and a series of snap receptacles 126. The hooks 124 may be L-shaped projections, each with a first leg 128 extending from the rear surface 112 of the front shell 18 and a second leg 130 extending upwardly at about a 90-degree angle from the first leg 128. As illustrated, the hooks 124 are positioned adjacent to the top edge 116 of the front shell 18 such that each hook 124 aligns with an associated one of the hook receptacles 82 on the rear shell 16. The snap receptacles 126 may be holes or openings that extend through the front shell 18. The snap receptacles 126 may each include a retention ring 132 extending into the opening for retaining a head 90 of one of the snap posts 84. The snap receptacles 126 may be positioned adjacent to the bottom edge 122 and lower portions of the side edges 118, 120 of the front shell 18 such that they each align with an associated one of the snap posts 84 on the rear shell 16 when the front and rear shells 18, 16 are aligned. Referring now to FIG. 4, in one embodiment, the front shell 18 may include a series of drawstring posts 140 extending from the rear surface 112 of the front shell 18 for routing and retaining a drawstring (discussed below) connected to the cover 22.

In one embodiment, the front shell 18 further includes a central flex section 200. The central flex section 200 is a section of the front shell 18, located generally in a laterally central position in the lumbar region of the front shell 18, that provides a degree of movement with respect to the remainder of the front shell 18, and may further provide a greater degree of flexibility than the remainder of the front shell 18. Referring to FIG. 8, in one embodiment, the central flex section 200 is formed by an outer slot 202 defined in the front shell 18. The outer slot 202 extends around the central flex section 200, forming an upper edge 204, left 206 and right 208 side edges, and a bottom edge 210. The outer slot 202 substantially separates the central flex section 200 from the remainder of the front shell 18. In the illustrated embodiment, the central flex section 200 is connected to the remainder of the front shell 18 only by a series of connector webs 212 that traverse the outer slot 202. As shown there are three such connector webs 212, including a left lateral connecter web 214 connected between the left lateral edge 206 and the remainder of the front shell 18, a right lateral connector web 216 connected between the right lateral edge 208 and the remainder of the front shell 18, and a bottom connector web 218 connected between the bottom edge 210 and the remainder of the front shell 18. As a result, of there being no connector webs 212 between the upper edge 204 and the remainder of the front shell 18, and further as a result of the left and right lateral connector webs 214, 216 being spaced from the upper edge 204, the central flex section 200 can be flexed about the connector webs 212 to move with respect to the remainder of the front shell 18. Alternative numbers of connector webs 212 in varied locations may be used in different embodiments to alter the movement and support characteristics of the central flex section 200. The connector webs 212 may all be formed of the same size, or of varied sizes, depending on the application and desired support characteristics. In the illustrated embodiment, the left lateral connector web 214 and right lateral connector web 216 are of the same width, whereas the bottom connector web 218 is wider and longer than the lateral connector webs 214, 216.

As noted, the central flex section 200 can also be configured to be more flexible than the remainder of the front shell 18. As shown in FIGS. 4 and 5, for example, the central flex section 200 may include a series of internal or inner slots 220, spaced inside the outer slot 202, than enable an increased degree of flexibility within the central flex section 200. In this way, the central flex section 200 provides both movement with respect to the remainder of the front shell 18 about the connector webs 212, and internal flexibility of a greater degree than the remainder of the front shell 18 as provided by the internal slots 220. As illustrated, the inner slots 220 are a series of spaced apart slots including vertically spaced horizontal internal slots 222 and horizontally spaced, vertically extending internal slots 224. In one embodiment, the horizontal slots 222 are arranged in three columns of slots 222, and the vertically extending slots 224 are positioned outside the horizontal slots 222 on opposing lateral sides of the central flex section 200 adjacent to the left lateral edge 206 and the right lateral edge 208 of the central flex section 200. In the illustrated embodiment, the vertical 224 and horizontal 222 slots form columns of vertically spaced strips 223, and horizontally spaced strips 225.

In one embodiment, the back support 12 includes a vertically adjustable lumbar pad 24 positioned between the front 18 and rear 16 shells, and the front shell 18 may be provided with structure that enhances the user experience of the lumbar pad 24. Referring to FIG. 10, the lumbar pad 24 is generally a molded, flexible, plastic pad having a front surface 230 and a rear surface 232. The front surface 230 may have a concave shape, and the rear surface 232 may have a generally convex shape such that the overall shape of the lumbar pad 24 matches the curvature of the front 18 and rear 16 shells. In the illustrated embodiment, the lumbar pad 24 includes an annular perimeter portion 234, and a central portion 236 that is recessed rearwardly from the perimeter portion 234. The central portion 236 may have opposing lateral ends 238 connected to the perimeter portion 234, and the remainder of the central portion 236 may be separated from the perimeter portion 234 by one or more slots 240 extending through the pad 24. In one embodiment, the central portion includes a forward surface 242 facing the front shell 18, and (as shown in FIG. 4) a rear surface 244 facing the rear shell 16. The rear surface 244 includes a pair of attachment holes 245 for attachment to a lumbar carriage 250.

Figure 14:
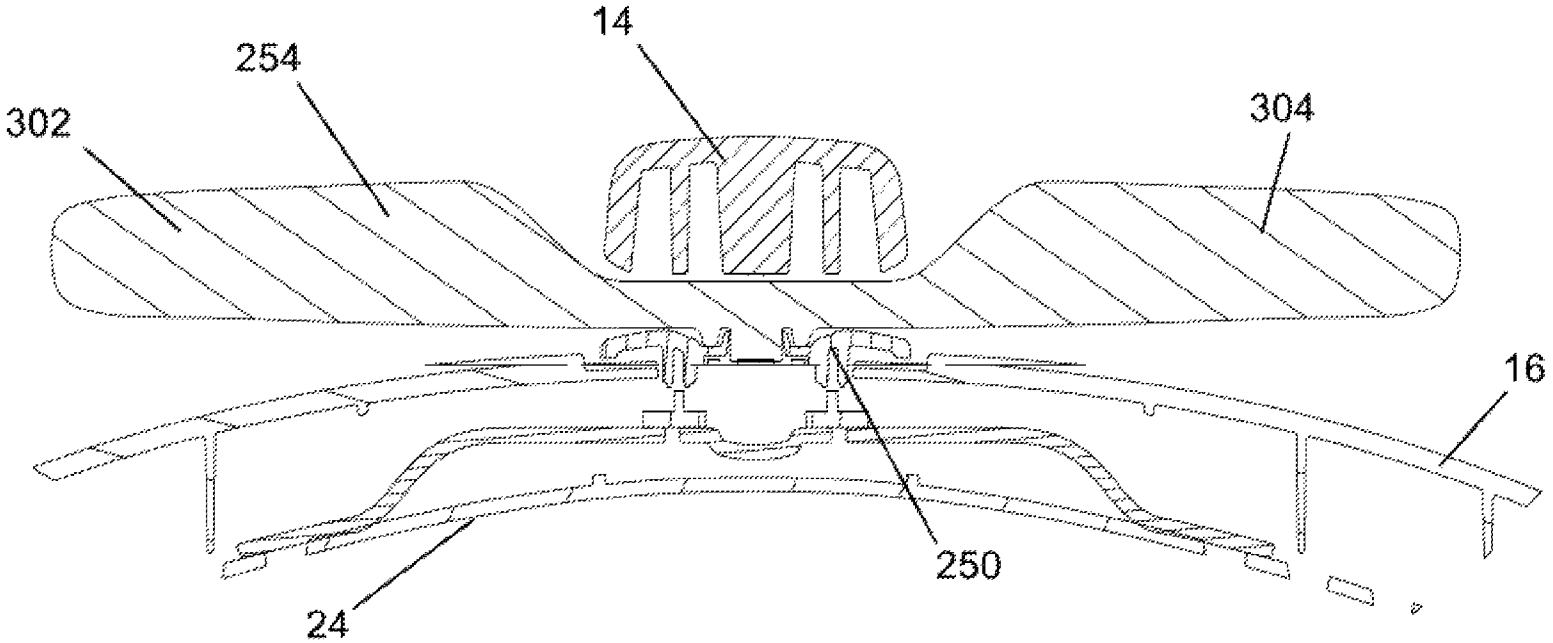
FIG. 14 is a top view of a lumbar mechanism according to one embodiment.
Figure 17:
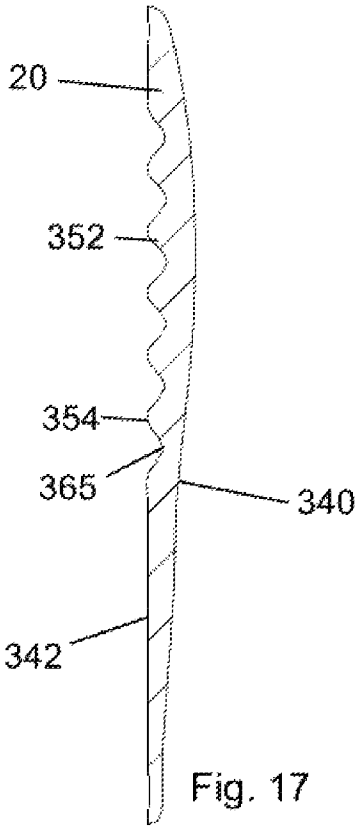
FIG. 17 is a side cross sectional view along line B-B in FIG. 15.
Figure 16:
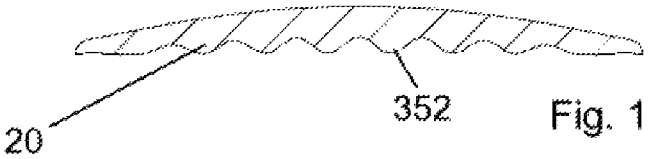
FIG. 16 is a top cross sectional view along line A-A in FIG. 15.
Figure 15:
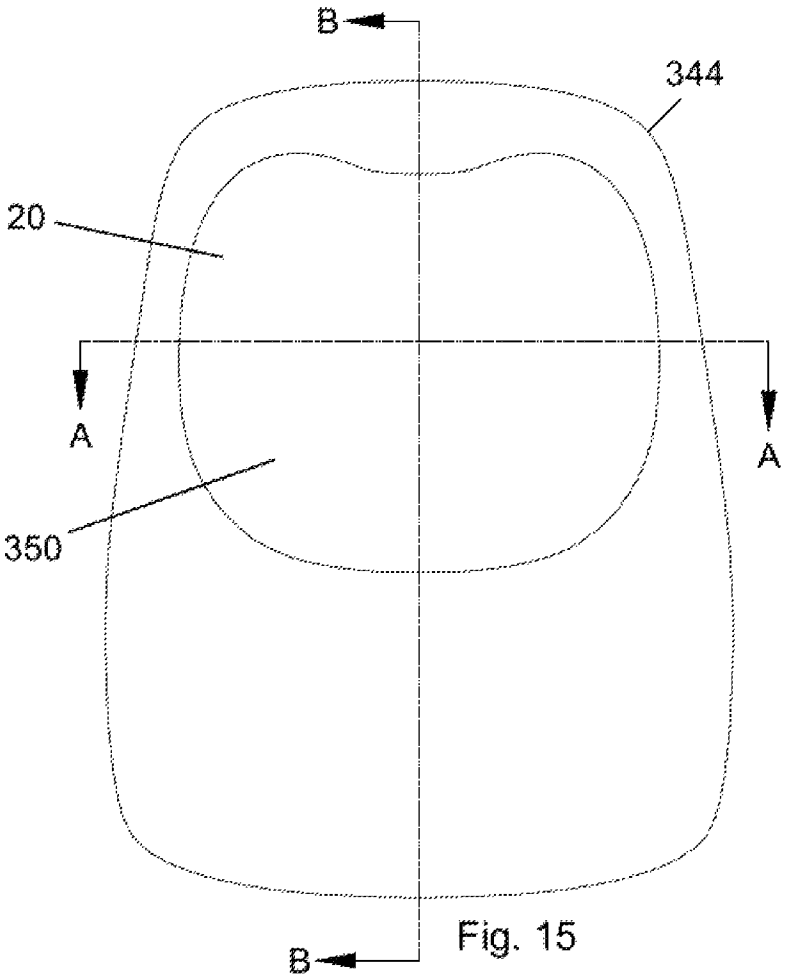
FIG. 15 is a front view of a cushion according to one embodiment.

FIGS. 12-14 illustrate the lumbar carriage 250, lumbar track 252 and lumbar handle 254. The lumbar carriage 250 connects to the lumbar pad 24 and the lumbar handle 254 to enable a user to manipulate the handle 254 to vertically adjust the lumbar pad 24. The lumbar carriage 250 generally includes a forward surface 260 facing the lumbar pad 24 and a rear surface 262 facing the lumbar handle 254. In the illustrated embodiment, the lumbar carriage 250 includes a vertically extending spine 264, an upper lateral arm 266 extending from the spine 264, and a lower lateral arm 268 extending from the spine 264. The spine 264 defines a pair of vertically spaced attachment holes 270. The spine 264 supports a pair of upwardly extending flex fingers 265, and a pair of downwardly extending flex fingers 267. Each of the flex fingers 265, 267 is laterally flexible, and each includes an outwardly projecting knob 269. The lower lateral arm 268 supports a pair of upwardly extending lower flex fingers 272, and the upper lateral arm 266 supports a pair of downwardly extending upper flex fingers 274 and a pair of upwardly extending attachment fingers 276. The attachment fingers 276 are laterally spaced from each other and generally each include a tab protrusion 280 extending forwardly from the upper end 282 of each attachment finger 276. In one embodiment, the tab protrusions 280 are spaced to align with and fit within the attachment holes 245 on the lumbar pad 24, such that the carriage 250 supports the lumbar pad 24 with the attachment fingers 276 providing a degree of flex for the lumbar pad 24.

In one embodiment, the lumbar track 252 is a generally vertically extending ring having a front surface 280, a rear surface 282, a perimeter edge 283, and defining a vertically extending slot 284. The lumbar track 252 may be formed from plastic, and may be sized and shaped to fit into the lumbar slot 100 of the rear shell 16 with perimeter edge 283 at the front surface 280 of the track 252 being at least slightly larger than the opening of the lumbar slot 100 in order to cover the lumbar slot opening 100. The vertical extent of the track slot 284 may be generally aligned with the vertical extent of the lumbar slot 100 in the rear shell. In one embodiment, a right detent bar 290 and a left detent bar 292 extend from the front surface 280 spaced inwardly from the perimeter edge 283. The detent bars 290, 292 may project at least partially through the lumbar slot 100 in the rear shell 16. As illustrated, the left and right detent bars 290, 292 include opposing, facing surfaces 294 having vertically spaced apart notches or detents 298 for selectively receiving the knobs 269 of the flex fingers 265, 267 of the carriage 250 as described in more detail below. The track 252 may include one or more features for attaching the track 252 to the rear shell 16 and the support frame 14. As illustrated, the track includes a securement boss 253 at an upper end and a pair of securement openings 255 at a lower end.

The lumbar handle 254 attaches to the lumbar carriage 250 through the slot opening 284 in the track 252 such that the lumbar handle 254 and the lumbar carriage 250 travel in unison. Referring to FIG. 9, in the illustrated embodiment, the lumbar handle 254 includes a central attachment section 300 and a pair of handle grips 302, 304 extending laterally outwardly from opposing sides of the central attachment section 300. The central attachment section 300 may define a pair of securement holes 303, and the lumbar handle 254 may attach to the carriage 250 by one or more fasteners 306 extending through the securement holes 303 and into the vertically spaced attachment holes 270 on the spine 264 of the carriage 250. At least a portion of the central attachment section 300 may insert into the track slot 284 such that the central attachment section 300 rides vertically along and is directed by the track slot 284. As noted above, the flex fingers 265, 267 of the carriage 250 may be biased into the detents 298 of the track 284, and may flex as a user vertically adjusts the handle 254 to selectively insert into detents 298 as the carriage 250 is raised or lowered, and thus selectively retaining the lumbar pad 24 in a desired detent 298 and a desired vertical position once the user ceases vertical adjustment. The fingers 272, 274 of the carriage 250 may ride against the track 252 as the lumbar pad 24 is vertically adjusted. Notably, the shape and support characteristics of the lumbar pad 24, the track 252, and carriage 250 may be changed depending on the desired application, and the handle 254 may have any shape that enables adjustment by a user. In one embodiment, the track 252 may be integrally molded with the rear shell 16.

Figures 6A, 6B:
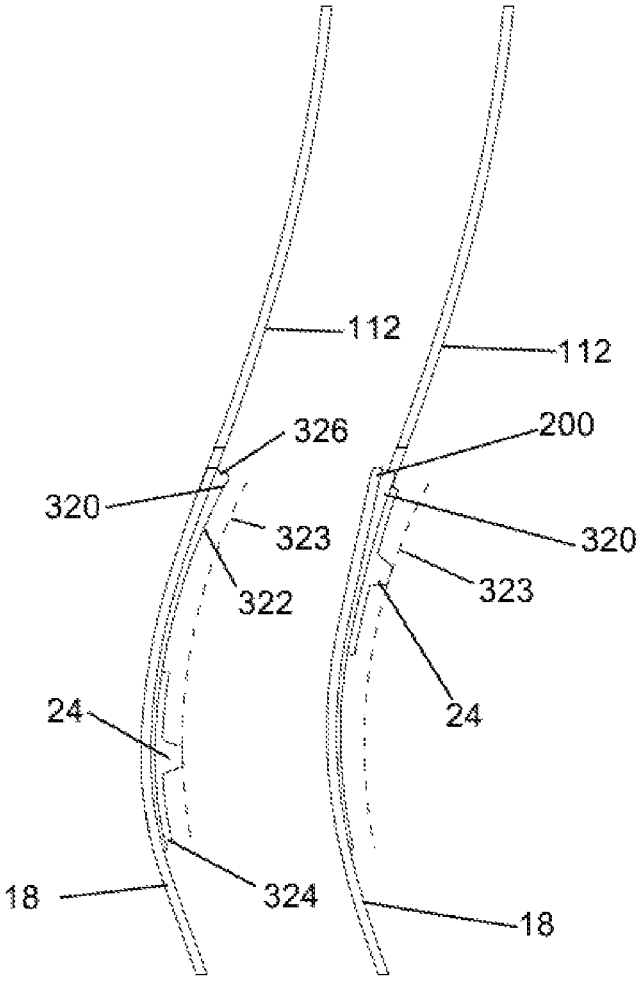
FIG. 6A is a side schematic view of the front shell and lumbar pad, with the lumbar pad in a lowered position.
FIG. 6B is a side schematic view of the front shell and lumbar pad, with the lumbar pad in a raised position.
Figure 7:
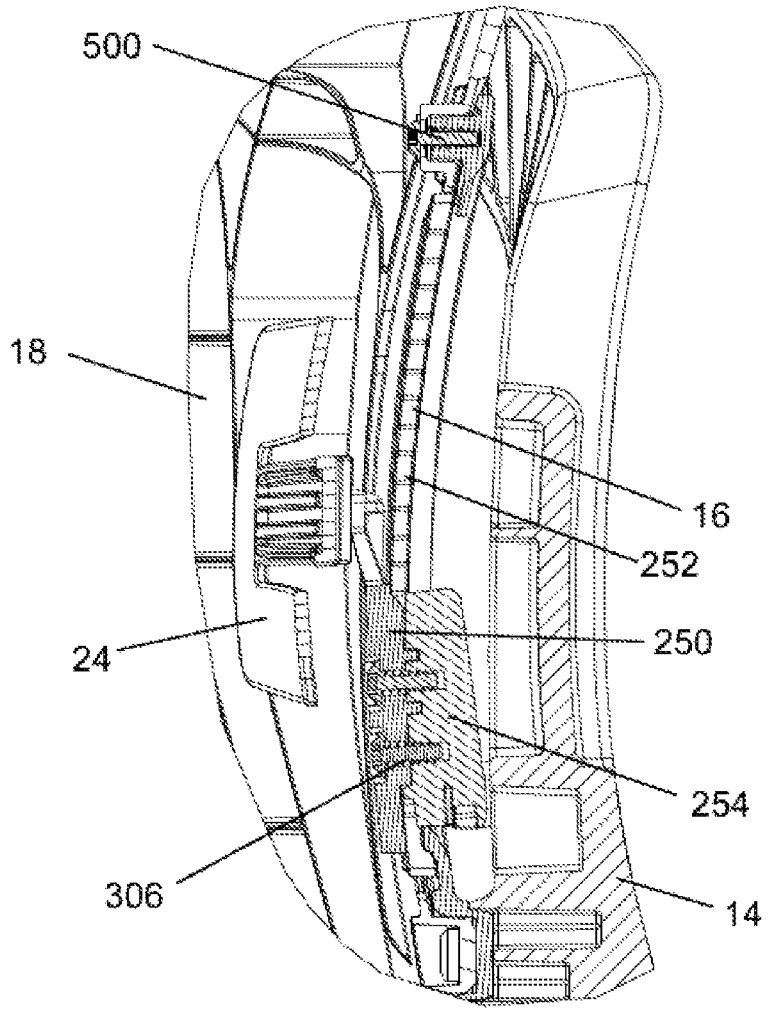
FIG. 7 is a side cross sectional view of a portion of the back support according to one embodiment.

In one embodiment, shown, for example, in FIG. 4 and FIGS. 6A and 6B, the front shell 18 includes structure for selectively engaging the lumbar pad 24 and enhancing the user experience of lumbar support on the front shell 18. As illustrated, this structure is provided in the form of a series of lumbar enhancement ribs 320 that extend rearwardly from the rear surface 112 of the front shell 18. In the illustrated embodiment, a series of four lumbar enhancement ribs 320 are positioned on the rear surface 112 within the central flex section 200. The lumbar enhancement ribs 320 may be integrally molded with the front shell 18, and in one embodiment are spaced apart horizontally, and generally evenly, on the central flex section 200. The lumbar enhancement ribs 320 may each have an outer edge 322, and each of the lumbar enhancement ribs 320 defines a rib height from the rear surface 112 of the front shell 18 to the outer edge 322. The rib height may vary along the vertical extent of the lumbar enhancement ribs 320, and is sized to create a desired degree of interference with the lumbar pad 24 as the pad moves along a lumbar path 323 (depicted in broken lines in FIGS. 6A and 6B) for selectively enhancing the user experience and pressure distribution of the lumbar pad 24 as the lumbar pad 24 is vertically adjusted. As shown, the rib height of the lumbar enhancement ribs 320 gradually increases from a lower end 324 of the lumbar enhancement rib 320 to an upper end 326 of the lumbar enhancement rib 320, providing the outer edges 322 of the lumbar enhancement ribs 320 with an arc-like shape. As described in more detail below, as the lumbar pad 24 is vertically adjusted along the track 252, the front surface 230 of the perimeter portion 234 of the pad 24 engages the outer edges 322 of the lumbar enhancement ribs 320 such that the lumbar enhancement ribs 320 create a desired pressure distribution of the front shell 18 as the lumbar pad 24 engages the lumbar enhancement ribs 320. In one embodiment, the lumbar pad 24 engages the lumbar enhancement ribs 320 along the complete extent of the vertical adjustment path of the pad 24, although in another embodiment, the lumbar pad 24 may engage the ribs 320 for only a portion of the vertical adjustment. In another embodiment, the lumbar enhancement ribs 320 may have a different shape as desired, depending on the desired support characteristics for the front shell 18 as it is engaged by the lumbar pad 24. As shown in FIG. 6B, in one embodiment, as the lumbar pad 24 is raised along the lumbar enhancement ribs 320, the force of the lumbar pad 24 on the front shell 18 within the central flex section 200 causes the upper edge 204 of the central flex section 200 to flex forwardly with respect to the remainder of the front shell 18 resulting in the desired pressure distribution for the user.

The cushion 20 is positioned between the front shell 18 and the cover 22, and provides an added degree of comfort and support for a user. The cushion 20 may further be constructed to cooperate with the front shell 18 and the lumbar pad 24 to provide coordinated support characteristics for the back support 12. In the illustrated embodiment, the cushion 20 is a molded foam having a front foam surface 340, a rear foam surface 342 and a foam perimeter edge 344. The rear foam surface 342 faces and may abut the front surface 110 of the front shell 18. The foam perimeter edge 344 may be coterminous with that of the front shell 18 such that the cushion 20 fits onto the front surface 110 of the front shell 18. The cushion 20 has a thickness between the front 340 and rear 342 foam surfaces that is sufficient to provide the user with a desired degree of support.

Referring to FIGS. 4, 5, and 15-17, the cushion 20 includes a convoluted section 350 having a convoluted or egg shell shape, wherein at least one of the front 340 and rear 342 surfaces of the cushion 20 have convoluted features 352 in the manner of an egg crate type foam, with a series of repeating hills 354 and valleys 365 in the surface of the foam in the convoluted section 350. In one embodiment, the convolutions are provided on the rear foam surface 342, and the depth of the valleys 365 is proportional to the thickness of the foam (i.e., the hills in the center are slightly deeper than those near the perimeter edge 344). The convoluted features 352 may be added during the mold operation such that the cushion 20 can be formed in a single manufacturing step. As, shown the convoluted features 352 are added only to a specific targeted region of the back support 12, and in the illustrated embodiment these features 352 are provided in the thoracic region X, and the substantial part of the convoluted section is spaced above the lumbar region Y and correspondingly above the central flex section 200 of the front shell 18 such that the support and flexibility features of the front shell 18 and the cushion 20 are coordinated to provide desired comfort and support characteristics in different sections of the back support 12.

Figure 2:
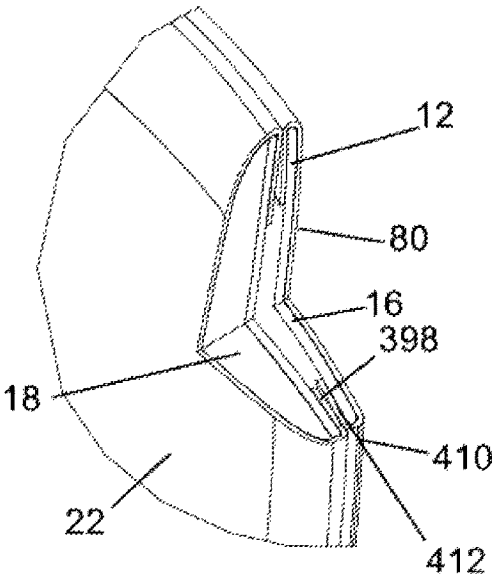
FIG. 2 is a close up view of the portion of the back support in circle A in FIG. 1.

As shown in FIGS. 1-4, the back support 12 further includes a cover 22. The cover 22 extends over the front surface 340 of the cushion 20 to form an exposed, user facing surface of the back support 12. The cover 22 may be made from a variety of materials, and in one embodiment is a fabric material that may be knit, woven, or otherwise formed to provide an upholstery. As shown, the cover 22 includes a front surface 370 and a rear surface 372. The rear surface 372 faces and generally abuts the front surface 340 of the cushion 20. The cover 22 may include a central cover region 374 and a perimeter region 376 extending from the central cover region 374 to a cover perimeter edge 378. The perimeter region 376 may extend rearwardly from the central cover region 374 such that it wraps around the perimeter edge 344 of the cushion 20 and the perimeter edge 114 of the front shell 18 to conceal the edges 344, 114. The perimeter region 376 may also define a drawstring channel 380 adjacent the perimeter edge 378, wherein a drawstring 390 is inserted and can be drawn at a drawstring opening 392 to pull the cover 22 tightly around the front shell 18. The drawstring 390 may be drawn about the drawstring posts 140 extending from the rear surface 112 of the front shell 18 for routing and retaining the drawstring to the cover 22. As shown in FIG. 2, when the back support 12 is assembled, an insertion portion 398 of the perimeter region 376 is inserted between the front shell 18 and the rear shell 16 to form a finished edge that conceals the perimeter edges 344, 114 of the cushion 20 and front shell 18.

In one embodiment, the back support 12 additionally includes a rear cover 80. Shown, for example, in FIG. 18, the rear cover 80 may be a fabric material similar to or the same as the cover 22, and the rear cover 80 may extend over the rear surface 58 of the rear shell 16 to form a cover for the rear shell 16. As illustrated, the rear cover 80 defines openings 402 for the bosses 50 of the frame 14 extending therethrough, and an opening 404 for insertion of the lumbar track 252 therethrough. More particularly, in the case of the lumbar track 252, the opening 404 may be sized smaller than the extent of the perimeter edge 283 of the lumbar track 252 such that the lumbar track 252 forms a cover for with opening 404 with the detent bars 290, 292 protruding through the opening 404. Referring now to FIG. 2, the rear cover 80 may include a perimeter region 410 that wraps around the rear shell 16, and the rear cover 80 may further include an insertion portion 412 that is inserted between the front shell 18 and the rear shell 18 (in a manner similar to the insert portion 398 of the cover 22) to form a finished appearance for the back support 12 with the insert portions 398, 412 of the respective covers 22, 80 adjacent to one another in the assembled product.

III. Manufacture and Use

Assembly of the back support 12 generally includes forming the rear shell 16 and the front shell 18, for example, by molding the shells 16, 18 from a thermoplastic material. Formation of the rear shell 16 may include the step of integrally molding the variety of molded features of the rear shell 16, including the lateral openings 70, 72 and the bottom opening 74 for attachment of the rear shell 16 to the support frame 14, and molding in the attachment structure for attachment to the front shell 18 and the rear cover 80, such as the hook receptacles 82 and the snap posts 84 for tool-less attachment to the front shell 18, the support ribs 92, the one or more drawstring guides 96, and the lumbar slot 100. As noted above, in one alternative embodiment, the lumbar track 252 may also be molded integrally with the rear shell 16.

Formation of the front shell 18 can be competed in a similar manner, via molding the front shell 18 from a thermoplastic material. The molding of the front shell 18 may include the integral formation of the variety of molded in front shell 18 components, including the series of hooks 124 and snap receptacles 126 for attaching to the rear shell 16, and the front shell may include drawstring posts 140 for routing and retaining the drawstring 390 of the cover 22. The front shell 18 may additionally be molded to include a central flex section 200, including the molding of the series of connector webs 212 connecting the central flex section 200 to the remainder of the front shell 18, and the vertical 225 and horizontal 223 strips that provide the central flex section with internal flexibility.

The cushion 20 is positioned in front of the front shell 18 with the foam perimeter edge 344 of the cushion 20 aligned with the perimeter edge 114 of the front shell 18 and the rear foam surface 342 of the cushion 20 facing the front surface 110 of the front shell 18. In the illustrated embodiment, wherein the cushion 20 includes a convoluted section 350, the convoluted section 350 is positioned to be aligned substantially above the central flex section 200 of the front shell 18, although other arrangements between the flex section and convoluted section are possible, depending on the desired support characteristics of the back support 12.

With the cushion 20 in place, the cover 22 is attached to the front shell 18 over the cushion 20. In the illustrated embodiment, the cover 22 is attached to the front shell 18 by placing the rear surface 372 of the central cover region 374 of the cover 22 over the cushion 20, wrapping the perimeter region 376 around the perimeter edge 114 of the front shell 18, and positioning the insertion portion 398 on the rear surface 112 of the front shell 18 with the drawstring 390 routed around the drawstring posts 140. The drawstring 390 may be drawn tight, to tighten the cover 22 on the front shell 18, and tied off or attached to the front shell 18, for example, with a fastener or a series of fasteners, to hold the drawstring 390 and cover 22 in place. In a similar manner, the rear cover 80 may be placed over the rear surface 58 of the rear shell 16, with the perimeter region 410 wrapped around the rear shell 16, and the insert portion 412 positioned against the front surface 56 of the rear shell 16. A drawstring (not shown) on the rear cover 80 may be routed about the drawstring guides 96 on the rear shell 16 and tied or attached to the rear shell 16 to secure the rear cover 80 in place.

The lumbar pad 24 and carriage 250 are provided between the front 18 and rear 16 shells. The lumbar pad 24 is attached to the carriage 250, for example, by inserting the tab protrusion 280 of each of the attachment fingers 276 of the carriage 250 into the attachment holes 245 on the lumbar pad 24, with the front surface 230 of the lumbar pad 24 facing the rear surface 112 of the front shell 18. The lumbar track 252 and lumbar handle 254 are provided on an opposite side of the rear shell 16, adjacent the lumbar slot 100 in the rear shell 16, and the detent bars 290, 292 of the lumbar track 252 are inserted at least partially through the lumbar slot 100. The lumbar track 252 may be attached to the rear shell 16, for example, by the fastener 500 extending through the securement boss 253 on the track 252 and the fastener hole 73 on the rear shell 16, and a pair of the fasteners 52 extending through the securement openings 255 and the fastener holes 74 on the rear shell 16 with the track 252 also forming a cover for the opening 404 in the rear cover 80.

With the track 252 secured in place on the rear shell 16 adjacent to the rear surface 58 of the rear shell 16, the carriage 250 is positioned adjacent to the lumbar slot 100 on the front surface 56 of the rear shell 16 and attached to the handle 254 through the lumbar slot 100 and the track slot 284 via fasteners 306 extending through the attachment holes 270 in the spine 264 of the carriage 250 and the securement holes 303 in the central attachment section 300 of the handle 254. In this position, each of the knobs 269 on flex fingers 265, 267 on the carriage 250 can interfit with a corresponding detent 298 in the detent bars 290, 202 of the track 252.

The front 16 and rear 18 shells are connected to one another via the mating attachment structure on the shells 16, 18. More particularly, the front shell 18 can be attached to the rear shell 16 by aligning the rear surface 112 of the front shell 18 with the front surface 56 of the rear shell 16, with the hooks 124 of the front shell 18 aligned with the hook receptacles 82 of the front shell 18, and with the snap receptacles 126 of the front shell 18 aligned with the snap posts 84 of the rear shell 16. The hooks 124 may then be inserted into the hook receptacles 82 by inserting the upwardly extending second legs 130 of each of the hooks 124 into an associated one of the open bottom edges 86 of each of the hook receptacles 82. The snap posts 84 and snap receptacles 126 may then be snap-fit together by inserting the head 90 of each of the snap posts 84 into and through the retention ring 132 of each of the snap receptacles 126. As shown in FIG. 2, the insertion portion 398 of the cover 22, and the insertion portion 412 wrap around the respective shells 16, 18 and abut each other between the shells 16, 18. In another embodiment, a different securement method may be used for connecting the front 18 and rear 16 shells, such as a series of fasteners or an alternative fastener-less structure.

The rear shell 16 is supported on the support frame 14 to fully assemble the back support 12. As shown, for example, in FIG. 4, the fasteners 53 extend through the lateral openings 70, 72 in the rear shell 16 and into the attachment bosses 50 on the lateral posts 34, 36 of the support frame 14. The fasteners 52 extend through the securement openings 255 in the track 252 and into the bottom opening 74 in the rear shell 16. As noted above, the support frame 14 may connect to the base 5 of the chair 10.

As an occupant or user sits on the seat support 3 of the chair 10, the occupant receives support from the back support 12. Each of the front shell 18 and the rear shell 16 may have a degree of flexibility to curve around the occupant as the occupant engages the back support 12. The cushion 20 provides an added layer of comfort and support, with the convoluted section 350 providing an enhanced degree of comfort in the occupant's thoracic region (above the lumbar region). The central flex section 200 may provide increase support and comfort characteristics, as the central flex section 200 moves with respect to the remainder of the front shell 18 due to the spaced apart connector webs 212 and the absence of connector webs 212 between the upper edge 204 of the central flex section 200 and the remainder of the front shell 18. The lumbar pad 24 may be vertically adjusted by an occupant providing a vertical force on the lumbar handle 254, causing the flex fingers 265, 267 to flex and selectively engage the detents 298 on the track 252. As the lumbar pad 24 is adjusted, the front surface 230 of the lumbar pad 24 may engage the lumbar enhancement ribs 320 on the front shell 18. The gradual increase in rib height of the lumbar enhancement ribs, combined with the flexibility of the central flex section 200 from which the lumbar enhancement ribs 320 extend, can increase the amount that the occupant feels and is supported by the lumbar pad 24 as the lumbar pad 24 is moved vertically upwardly. Notably, in another embodiment, the back support 12 may not include the lumbar pad 24, and in such an embodiment the lumbar slot 284 and lumbar pad accessories may be eliminated.

In summary, the support characteristics of the back support 12 may be tuned to a desired profile by varying the features of the back support 12, such as the flexibility of the front 18 and rear 16 shells, the number and positioning of the connector webs 212, the positioning and spacing of the inner slots 220 of the central flex section 200, and the size and positioning of the central flex section 200 and the convoluted section 350 of the cushion 20. The support characteristics of the lumbar pad 24 can be varied by adjusting the flexibility and shape of the pad 24, and the size and positioning of the lumbar enhancement ribs 320. Combinations of modifications to the individual components results in highly customizable support characteristics available to design into the office chair.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s). Any reference to claim elements in the singular, for example, using the articles "a," "an," "the" or "said," is not to be construed as limiting the element to the singular.

The embodiments of the invention in which an exclusive property or privilege is claimed are defined as follows:

1. A back support for an office type chair, comprising:

a support frame;

a rear shell mounted to the support frame, the rear shell having a rear surface facing the support frame, and a front surface opposite the rear surface, the rear shell defining a lumbar region;

a front shell having a rear surface facing the rear shell and a front surface opposite the rear surface, the front shell rear surface attached to the rear shell front surface;

a cushion having a rear surface facing the front shell and a front surface opposite the rear surface; and a cover positioned over the front surface of the cushion, wherein at least a portion of the cover wraps around the cushion and is inserted between the front shell and the rear shell;

including a lumbar pad positioned between the rear shell and the front shell;

wherein the lumbar pad is vertically adjustable within the lumbar region;

wherein the rear shell defines an opening in the lumbar region, the rear shell opening having a vertical extent, the back support including a handle adjacent to the rear surface of the rear shell and having a portion extending through the rear shell opening, the portion attached to the lumbar pad, wherein the handle is movable along the vertical extent of the rear shell opening, and wherein movement of the handle causes corresponding movement of the lumbar pad;

wherein at least one lumbar enhancement rib protrudes from the rear surface of the front shell toward the rear shell, the lumbar pad engaging the lumbar enhancement rib at least at one position during the vertical adjustment of the lumbar pad.

2. The back support of claim 1 wherein the lumbar enhancement rib extends in a generally vertical direction and defines a rib height in a direction extending away from the rear surface of the front shell, the rib height at an upper end of the lumbar enhancement rib being greater than the rib height at a lower end of the lumbar enhancement rib.

3. The back support of claim 2 wherein the rib height gradually increases from the lower end to the upper end.

4. The back support of claim 3 wherein the front shell includes a central flex section defined in the front shell, the central flex section separated from the remainder of the front shell by an outer slot extending around the central flex section to enable flexing of the central flex section with respect to the remainder of the front shell, the central flex section connected to the remainder of the front shell only by a series of connector webs, each of said webs traversing the outer slot.

5. The back support of claim 4 wherein the central flex section includes a top edge, left and right lateral edges, and a bottom edge formed by the outer slot, and wherein the back support includes no connector webs along the top edge.

6. The back support of claim 5 wherein the back support includes at least one left connector web on the left lateral edge of the central flex section and at least one right connector web on the right edge of the central flex section, the left and right connector webs spaced from the top edge of the central flex section.

7. The back support of claim 6 wherein the central flex section includes at least one inner slot spaced from the outer slot, the inner slot extending through the front and rear surfaces of the front shell to add a degree of flexibility to the central flex section.

8. The back support of claim 7 wherein the at least one inner slot includes a series of horizontally extending, vertically spaced inner slots within the central flex section.

9. The back support of claim 7 wherein the front surface of the cushion includes a central cushion section having convolutions, the central cushion section located generally above the central flex section of the front shell.

10. The back support of claim 9 wherein the support frame is Y-shaped, and includes a vertical support post and a pair of lateral support posts extending from the vertical support post, the support frame attached to the rear shell at three attachment points, wherein a first one of the attachment points is located on the vertical support post, and second and third attachment points are located on each of the respective lateral support posts.

11. A back support for an office type chair, comprising:

a support frame;

a rear shell mounted to the support frame, the rear shell having a rear surface facing the support frame, and a front surface opposite the rear surface;

a front shell having a rear surface facing the rear shell and a front surface opposite the rear surface, the front shell rear surface attached to the rear shell front surface;

a cushion having a rear surface facing the front shell and a front surface opposite the rear surface; and a cover covering the front surface of the cushion;

wherein the front shell includes a central flex section defined in the front shell, the central flex section separated from the remainder of the front shell by an outer slot extending around the central flex section to enable flexing of the central flex section with respect to the remainder of the front shell, the central flex section connected to the remainder of the front shell only by a series of connector webs, each of said webs traversing the outer slot; and including a lumbar pad positioned between the rear shell and the front shell, the lumbar pad being vertically adjustable, wherein the rear shell has a lumbar region, and wherein the rear shell defines an opening in the lumbar region, the rear shell opening having a vertical extent, the back support including a handle adjacent to the rear surface of the rear shell and having a portion extending through the rear shell opening, the portion attached to the lumbar pad, wherein the handle is movable along the vertical extent of the rear shell opening, and wherein movement of the handle causes corresponding movement of the lumbar pad;

wherein at least one lumbar enhancement rib protrudes from the rear surface of the front shell toward the rear shell, the lumbar pad engaging the lumbar enhancement rib at least at one position during the vertical adjustment of the lumbar pad.

12. The back support of claim 11 wherein the central flex section includes a top edge, left and right lateral edges, and a bottom edge formed by the outer slot, and wherein the back support includes no connector webs along the top edge.

13. The back support of claim 12 wherein the back support includes at least one left connector web on the left lateral edge of the central flex section and at least one right connector web on the right edge of the central flex section, the left and right connector webs spaced from the top edge of the central flex section.

14. The back support of claim 11 wherein the lumbar enhancement rib extends in a generally vertical direction and defines a rib height in a direction extending away from the rear surface of the front shell, the rib height at an upper end of the lumbar enhancement rib being greater than the rib height at a lower end of the lumbar enhancement rib.

15. The back support of claim 14 wherein the rib height gradually increases from the lower end to the upper end.

16. A back support for an office type chair, the back support including a lumbar region and a thoracic region above the lumbar region, the back support comprising:

a support frame having a pair of laterally extending frame portions;

a rear shell mounted to the support frame at the laterally extending frame portions, the rear shell having a rear surface facing the support frame, and a front surface opposite the rear surface, the rear shell defining an opening extending through the rear shell in the lumbar region, the opening having a vertical extent;

a front shell having a rear surface facing the rear shell and a front surface opposite the rear surface, the front shell rear surface attached to the rear shell front surface, the front shell defining a flex slot forming a central flex section in the lumbar region, the central flex section having a top, bottom, left and right side surfaces, the central flex section connected to the remainder of the front shell by a plurality of connector webs traversing the flex slot, the top edge of the central flex section being free from connector webs;

a cushion having a rear surface facing the front shell and a front surface opposite the rear surface;

a cover covering the front surface of the cushion, wherein the cover includes a periphery, and wherein the periphery of the cover is inserted between the front shell and the rear shell;

a lumbar pad positioned adjacent the rear surface of the front shell; and wherein the front shell includes structure in the form of a lumbar enhancement rib of varying height extending from the rear surface of the front shell within the central flex section in the lumbar region for variably engaging the lumbar pad and varying the amount of pressure on the front shell upon slidable movement of the lumbar pad along the structure.

17. A back support for an office type chair, comprising:

a support frame;

a rear shell mounted to the support frame, the rear shell having a rear surface facing the support frame, and a front surface opposite the rear surface;

a front shell having a rear surface facing the rear shell and a front surface opposite the rear surface, the front shell rear surface attached to the rear shell front surface the front shell having a lumbar region;

a cushion having a rear surface facing the front shell and a front surface opposite the rear surface; and a cover positioned over the front surface of the cushion;

a lumbar pad positioned between the rear shell and the front shell; and wherein at least one of the lumbar pad and the front shell includes structure in the form of a lumbar enhancement rib defining a rib height, a first end, and a second end, wherein the rib height varies in the lumbar region, the lumbar enhancement rib engaging the other of the lumbar pad and the front shell for variable engagement between the lumbar pad and the front shell upon vertical adjustment of the structure along the at least one of the lumbar pad and the front shell with respect to the other of the lumbar pad and the front shell.

18. The back support of claim 17 wherein the rib height at the first end of the lumbar enhancement rib is greater than the rib height at the second end of the lumbar enhancement rib.

19. The back support of claim 18 wherein the rib height gradually increases from the first end to the second end.

* * * * *